US006032603A

United States Patent [19]

Olcott

[11] Patent Number: 6,032,603

[45] Date of Patent: Mar. 7, 2000

[54] METHOD AND APPARATUS TO INCREASE THE VELOCITY OF SAILING VESSELS

[76] Inventor: Bernard Olcott, P.O. Box 3014, 62 Hackensack Plank Rd., Weehawken, N.J. 07087

[21] Appl. No.: 09/012,389

[22] Filed: Jan. 23, 1998

Related U.S. Application Data

[60] Provisional application No. 60/035,918, Jan. 23, 1997.

[51] Int. Cl.[7] ..... B63B 3/38; B63B 41/00; B63H 25/52

[52] U.S. Cl. ..... 114/140; 114/129; 114/138; 114/141; 114/149

[58] Field of Search ..... 114/140, 141, 114/130, 131, 132, 133, 138, 127, 128, 129, 39.1, 121, 39.14, 39.15, 149, 274

[56] References Cited

U.S. PATENT DOCUMENTS

| | | | |
|---|---|---|---|
| 1,924,871 | 6/1933 | Ludington | 114/130 |
| 4,058,076 | 11/1977 | Danshy . | |
| 4,074,646 | 2/1978 | Dorfman . | |
| 4,280,433 | 7/1981 | Haddock . | |
| 4,421,492 | 12/1983 | Leva | 114/79 |
| 4,703,708 | 11/1987 | Cohen | 114/141 |
| 4,759,308 | 7/1988 | Zander | 114/127 |
| 5,163,377 | 11/1992 | Calderon et al. | 114/39.1 |
| 5,313,905 | 5/1994 | Calderon | 114/140 |

*Primary Examiner*—Sherman Basinger
*Assistant Examiner*—Patrick Muldoon

[57] ABSTRACT

An asymmetric wing for decreasing the leeward drift of a vessel has two different surfaces, one of which is cambered in cross-section and the other which has less camber in cross-section or flat. The asymmetric wing has a leading edge pointed toward the bow of the vessel and the trailing edge pointed toward the stern of the vessel. The surfaces of the asymmetric wing can be selectively moved to the port or starboard sides of the vessel. For centerboard and sliding keel vessels, a pair of asymmetric wings are installed in trunks, each asymmetric wing having a first cambered surface and a second less cambered surface. The first cambered surfaces of the two asymmetric wings point in opposite directions. At any one time both asymmetric wings are not moved into the water. The asymmetric wing is applicable to vessels without a centerboard or sliding keel trunk. In such a case, a horizontal shaft extends through a single asymmetric wing and the single cambered surface is rotated to either port or starboard. The single asymmetric wing can be supported in a cavity in the keel or in a cavity in a separate support extending from the underside of the hull.

24 Claims, 11 Drawing Sheets

METHOD AND APPARATUS TO INCREASE THE VELOCITY OF SAILING VESSELS

CROSS-REFERENCE TO RELATED PATENT APPLICATIONS

A Provisional Application of the invention was filed on Jan. 23, 1997 under Ser. No. 60/035918 and is incorporated by reference.

FIELD OF THE INVENTION

This application relates to under-water wings and appendages for water-borne sailing vessels, and in particular to asymmetric appendages in physical arrangements and physical locations on sailing vessel hulls for providing enhanced lift to windward sailing vessels for shorting the path of the vessel to a windward destination and for increasing the forward velocity of the sailing vessel.

BACKGROUND OF THE INVENTION

In the description and claims, the following terms will be used and are defined as follows: an "appendage" is a protrusion from the hull, a "wing" is one kind of an appendage protruding from a hull of a vessel below the waterline and having at least one cambered surface for the purpose of providing lift; "lift" means a force generated by water passing over a cambered surface of a wing which counters the leeward drift force caused by wind on the vessel; an "asymmetric wing" means an appendage having a shape in crossection similar to the crossection of an airplane wing which has upper and lower surfaces of different cambers with span (lengthwise) and chord (crosswise) dimensions; "VMG" (Velocity Made Good) means the velocity of a sailing vessel towards its windward mark; and "drag" means lost energy as water passes over a moving submerged wetted surface which results in the reduction in velocity of a sailing vessel. "Lift/Drag Ratio" is the quantity of lift per unit of drag produced by a moving submerged cambered appendage. What is desired is lots of lift and little drag, the drag being unavoidable.

A "centerboard yacht" is a sailing vessel which has a "trunk" through which a pivoting wing is swingable into and out of the water. In a "sliding keel yacht", the wing is linearly slidable in its "trunk" into and out of the water.

Hydrofoil appendages were also known as "fins" and "wings" during the America's Cup Race of 1982 and at that time were also referred to as "winged keels" and "winglets" by the marine press. They are now referred to as "APPENDAGES" along with rudders, fin keels and keel trim tabs in Rule 19 of the International America's Cup Class Rules.

Ben Lexcen applied a winged keel (for which he filed Australian Patent Application AU-A-85 668/82 in 1982) to the 12 meter AUSTRALIA II yacht which successfully won the America's Cup Race of 1983. The next America's Cup Race in 1987 was won by the USA Yacht which had a winged keel.

The details and operational explanations of Ben Lexcen's winged keel on Australia II appears in the article entitled "KEELS", pages 50–56 of the January 1984 issue of the magazine "YACHT RACING and CRUISING". The author on page 55 using FIGS. 6*a* and 6*b* illustrates how Ben Lexcen with his "fins" can produce "keel lift" when the boat is tacking and heeled. As shown in FIG. 6*b* of the magazine article, when a sailboat is on tack, a force vector is generated perpendicular to and downward away from the slanted lower wing (which corresponds to one of the fins 5 in FIG. 3 of Ben Lexcen's Australian Patent Application) by the water rushing thereover, the horizontal component of the generated force counters and thereby reduces the magnitude of the leeward drift force produced by the wind acting on the sails. FIG. 5 in this application illustrates FIG. 3 in Ben Lexcen's Australian Patent Application when the yacht is sailed with a 20° heel on starboard tack. Its mathematically calculated performance will be used as a "base mark" reference from which to calculate the improved performance of the embodiments shown in the drawings, described in the specification and recited in the claims of this application.

Except for the "AUSTRALIA II" Yacht, other installed appendages by challengers and defenders for the 1983 Americas Cup Race did not improve their performances and were discarded, one reason being that the drag of their wetted surface appendages badly undercut the lift advantages. According to the "NAUTICAL QUARTERLY BOOK" with the title "UPSET: Australia Wins the America's Cup" in the late summer trials of 1982, the American Team could not successfully add "wings" to its defending yacht "MAGIC" (pgs. 81 & 88), nor could the British challenging yacht "VICTORY 83" (pgs. 86 & 88) be successful with "wings" attached to its keel. They failed because their yacht naval architects failed to observe and employ the essential relationships disclosed in the applicant's "Energy Balance" as described hereinafter.

The Deed of Gift for the America's Cup was written in 1853.

In 1887, the Third Gift of Deed was amended to set forth a deed provision for all America Cup Races thereafter as follows:

> "Centerboard or sliding keel vessels shall always be allowed to compete in any race for this Cup, and no restrictions nor limitation wherever shall be placed upon the use of such Centerboard or sliding keel, nor shall the Centerboard or sliding keel be considered a part of the vessel for any purpose of measurement."

By the New York State Supreme Court (the Trial Court), Appellate Division and Court of Appeals of the State of New York in 1988, the above 1887 Deed Provision was one of the critical factors in upholding the right of the winner of the 1988 America's Cup Race to use a Catamaran. After the 1988 race, the America's Cup Yacht Class was changed from the 12 Meter Class to the new International America's Cup Class (IACC). Of importance is that the above 1887 Deed of Gift Provision "Centerboard or sliding keel vessels shall always be allowed to compete in any race for this Cup . . . for any purpose of measurement." remains unchanged and available to be considered when designing new America's Cup Yachts.

BRIEF SUMMARY OF THE INVENTION

Crews in racing yachts desire to win races and crews in cruising sailboats desire to increase their "VMG" (speed) and to shorten the time on tacking and reaching passages.

It therefore seems desirable to provide an improved methods and improved embodiments to reduce the wind drift force vector with a counter "lift" force vector for two purposes:

(a) To reduce the drift energy so that the saved drift energy minus the increased drag energy propels the vessel forwardly, and (b) To shorten the path of the vessel around the windward mark by decreasing the vessel's leeward drift.

Thus there is a particular need for improved methods to design and employ one or more of applicant's asymmetrical wings to more decrease the wasted drift energy of the yacht than the added drag energy of the wing to achieve (a) and (b) above, for faster cruising and for winning races.

It therefore seems desirable to design new and improved appendages which are more efficient than the winged keel described in Australian Patent Application AU-A-85 668/82 and used in AUSTRALIA II which won the Americas Cup in 1983.

Thus there is a particular need to employ applicant's asymetric wings to provide higher lift/drag ratios than appendages which are now purchasable and unsatisfactory.

It therefore seems desirable to design a yacht which points higher into the wind.

Thus for sailing in all sea and wind conditions, there is a need to provide an asymmetrical hydrofoil wing which selectively controls the generation of a variable counter drift force vector as desired for all headings of the yacht.

During a tacking passage, it therefore seems desirable to point the sailing yacht higher into the wind.

Thus there i s a particular need to provide means to apply and selectively control a clockwise and counter clockwise twist by a submerged asymmetric wing to point the yacht higher into the wind.

In the exemplary embodiments of the invention, a single underwater asymmetric wing is juxtapositioned to the underside of the hull of a sailing vessel. The asymmetric wing has two different surfaces, one of which has a cambered cross-sectional shape and another which has a less cambered cross-sectional shape, or a flat shape. The wing has a leading cambered edge pointed towards the bow of the vessel and a trailing edge pointed towards the stern of the vessel. The asymmetric wing can be rotated in a appendage cavity, or slid linearly, or rotated, in a trunk supported by the hull.

In exemplary embodiments of the invention, the sailing vessel has two movable asymmetric wings, both wings having their cambered surface in perpendicular aspect to the vessels waterline plane and pointing perpendicularly in opposite directions relative to the longitudinal centerline of the sailing vessel. The asymmetric appendage is applicable to vessels with a trunk or without a trunk. In vessels without a centerboard trunk or sliding keel trunk, a shaft extends through the wing member and is connected to a means for rotating the wing member in a cavity of a submerged appendage. The rotation of the wing member selectively positions the hydrofoil surface on the port and starboard sides of the vessel. In another exemplary embodiment, the appendage may be a fin keel. In another exemplary embodiment, the vessel may have a centerboard trunk and two wing members, the wing member being rotatable in opposite directions. In a sliding keel an exemplary embodiment, a linearly sliding wing member replaces the pivoted centerboards.

In the methods of the invention, steps include entering a cambered hydrofoil appendage into the water from the hull of a sailing vessel in perpendicular aspect to the plane of the hull's waterline and positioning the cambered surface so that its leading edge points towards the bow of the vessel and the trailing edge points towards the stern of the vessel.

Both the methods and physical embodiments of the invention are focused upon a fundamental technical concept, namely, the energy balances between wind and water upon the quest to improve sailing yacht performance and in particular to improving its Velocity Made Good (VMG).

DETAILED DESCRIPTION OF THE INVENTION

Figure 1:
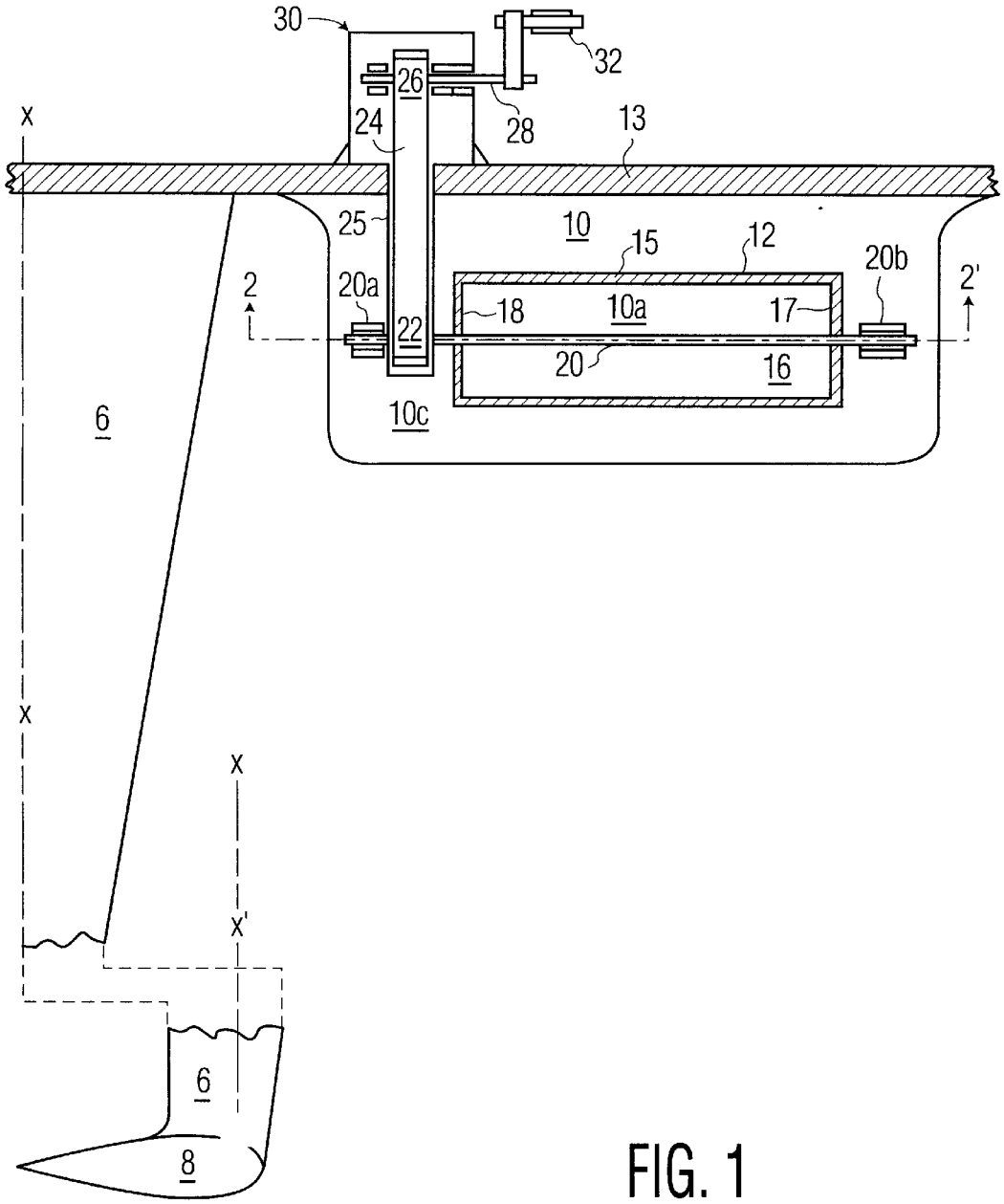
FIG. 1 is a partial schematic crossectional view of one embodiment an underwater asymmetric appendage.

Velocity Made Good (VMG) of a vessel, such as a tacking sailing yacht, is the velocity component in the direction of the windward mark. VMG is that component of the yacht's forward velocity vector which points toward the windward mark. Without considering leeward drift, the simplest explanation of VMG is by elementary trigonometry of a yacht moving at an angle of 45° to the wind. The VMG component is then 70.7% of the yacht's forward velocity. With leeward drift, the yacht's VMG is further reduced, its path around the mark is increased and the time to go around the windward mark is lengthened.

Wind and Water Forces Effecting Sailing Yacht Velocity

The influence of "Energy Balance" on the leeward drift and velocity of a tacking yacht will be formulated for exemplary embodiments having asymmetric appendages in arrangements and locations on a sailing yacht which is propelled by wind only and excluding the effect of water currents. No marine technology analysis will be given to the aspects and influences of vortex shedding, boundary layer separation, tip vortex, induced drag and keel downwash.

Energy Balance

The unavoidable result when an appendage is placed in moving water is an increase in drag due to the increase in wetted surface which tends to slow the yacht's forward velocity. Unfortunately, appendage drag can not be eliminated. So as to increase the forward velocity of the yacht, this application will disclose and teach how to design a sailing yacht with an asymmetric appendage or wing to controllably generate a counter drift force of a magnitude sufficient to more greatly reduce the energy which is wasted by the yacht moving in the drift direction than the wasted energy increase by the appendage drag. Such is accomplished so that the net energy saved over the increase in loss energy will increase the forward speed of the yacht. Energy interchanges to accomplish the desired increase in the yachts forward velocity will be explained in this application in accordance with an "Energy Balance Formula" which sets forth the energy relationships of the yacht's forward direction energy, the yacht's leeward drift energy, the drag energy loss and the associated entropy energy loss.

Energy analysis must observe the First and Second Laws of Thermodynamics which are considered to be scientifically inviolate. The two laws are:

First Law

Energy can neither be created nor destroyed. It can only be transferred, and

Second Law

All exchanges of energy are made with energy loss which explains why perpetual motion can not be achieved. The measure of this loss in every energy interchange is quantitatively expressed by thermodynamics term "Entropy", the index of unavailability of energy.

The only source of energy for a sailing vessel, is the wind energy, see First Law above. The energy of the wind is transferred to the sails (with entropy loss), and the energy from the sails is transferred to the hull via the mast, shrouds, stays and sheets (with entropy loss). A portion of the acquired hull energy propels the yacht forwardly and a portion of the hull energy moves the yacht leewardly. The sum of such two energies plus the unavoidable wasted energy of hull drag plus the unavoidable entropy loss equals the energy acquired by the hull from the wind. Therefore, when using the applicant's asymmetric wing, reduction in the leeward drift energy is available to be released to the hull energy which propels the yacht forwardly, provided the reduction in the wasted energy which is moving the yacht in the undesired leeward direction is greater than the added hull drag energy caused by the asymmetric wing plus the additional entropy losses. The many yachts which merely attached wings to existing keels without following the applicant's teaching herein generally failed to improve their velocity performance as explainable by the following mathematical analysis.

Representing the total energy available from the wind as W, the energy component driving the vessel forwardly as F, the energy component drifting the vessel leewardly as L, its component representing drag energy lost (water friction, wind friction, turbulence, etc.) as D and total entropy losses at every energy transfers as E, the energy balance is:

$$W=F+L+D+E \quad (1)$$

It will be assumed that the wind energy W remains constant and that F, L and D can be changed.

When any hydrofoil appendage is attached to the underside of the hull, or a wing is lowered from a trunk and into the water, there is the inescapable result that the drag energy loss D increases by the water friction passing over the submerged wing and E increases (by the extra energy transfer) and by complex changes, not here considered, produced by the hydrofoil appendage on vortex shedding, boundary layers, tip vortex and keel downwash. The inescapable drag energy loss D is increased to (D+d) and entropy loss E is increased to (E+e). Both act to reduce the wind energy available for forwardly propelling the yacht with the result that the boat can be expected to lose speed. But such will not happen if L (the energy wasted in leeward drift) is sufficiently reduced to (L−g). As a matter of mathematics, if the incremental reduction "g" in "L" is greater than the incremental increase "d" in D plus the incremental increase "e" in E, then energy "f" becomes available to increase F (the portion of the wind energy which propels the yacht) to (F+f) for increasing the yacht's forward velocity.

As stated here and before, the formula:

$$W=F+L+D+E \quad (1),$$

changes to:

$$W=(F+f)+(L-g)+(D+d)+(E+e) \quad (2)$$

and F increases to (F+f) when "g" is greater than "d"+"e".

While a cambered wing in moving water can generate a "force", it cannot create "energy", as established by the First and Second Laws of Thermodynamics. Technically speaking, "energy" is equal to "force times distance" and "power" is the time rate of "energy". Force with movement can produce energy and power.

Figure 2:
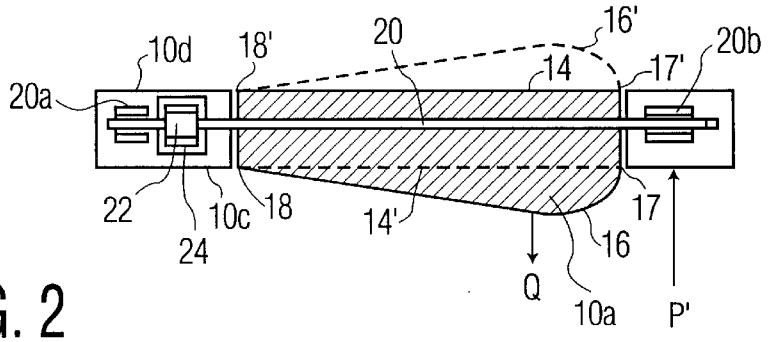
FIG. 2 is a partial crossectional view along line 2–2' of FIG. 1.
Figure 3:
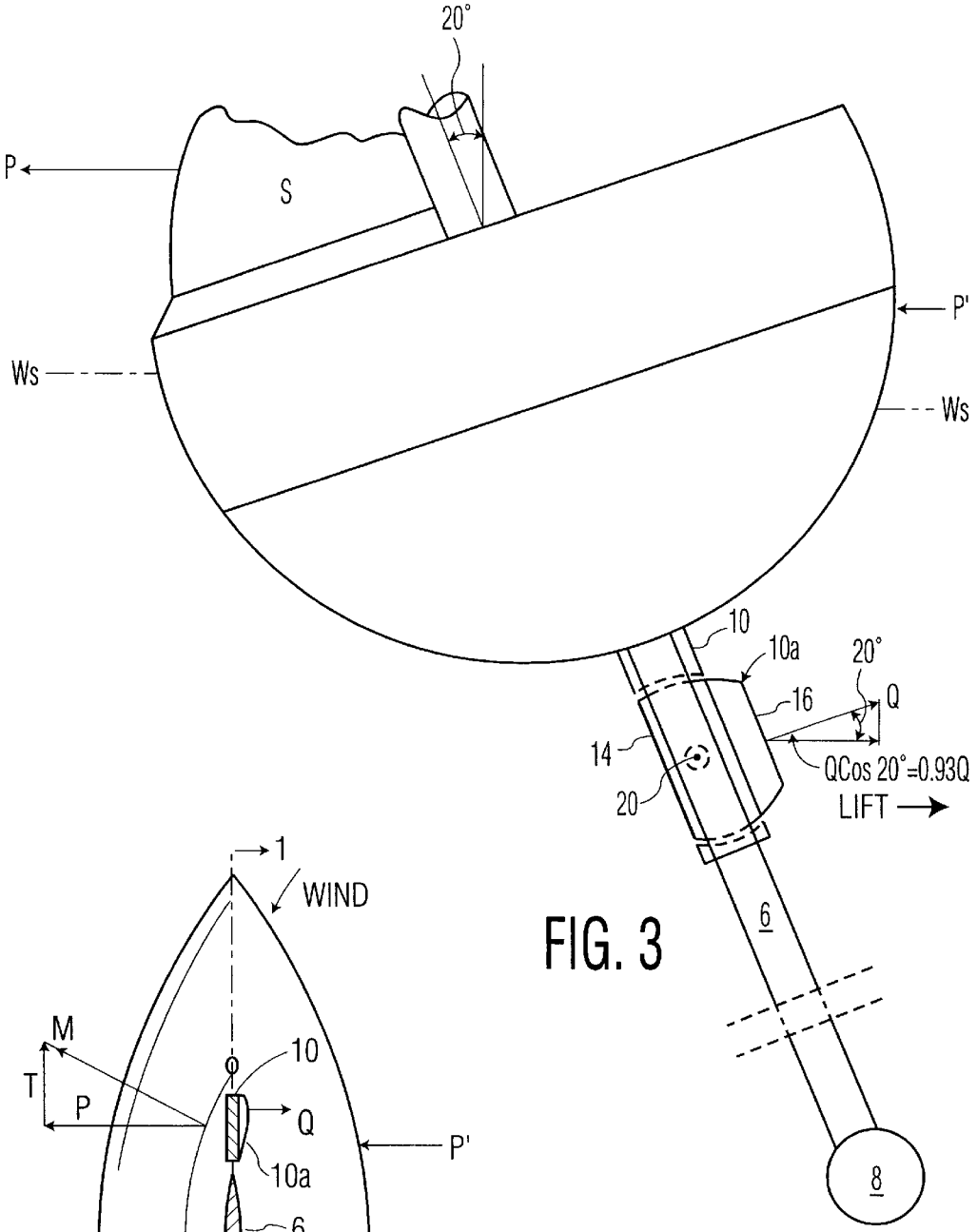
FIG. 3 is a partial schematic crossectional view of the embodiment of FIGS. 1 and 2 when the sailing yacht is on 20° starboard tack.
Figure 6:
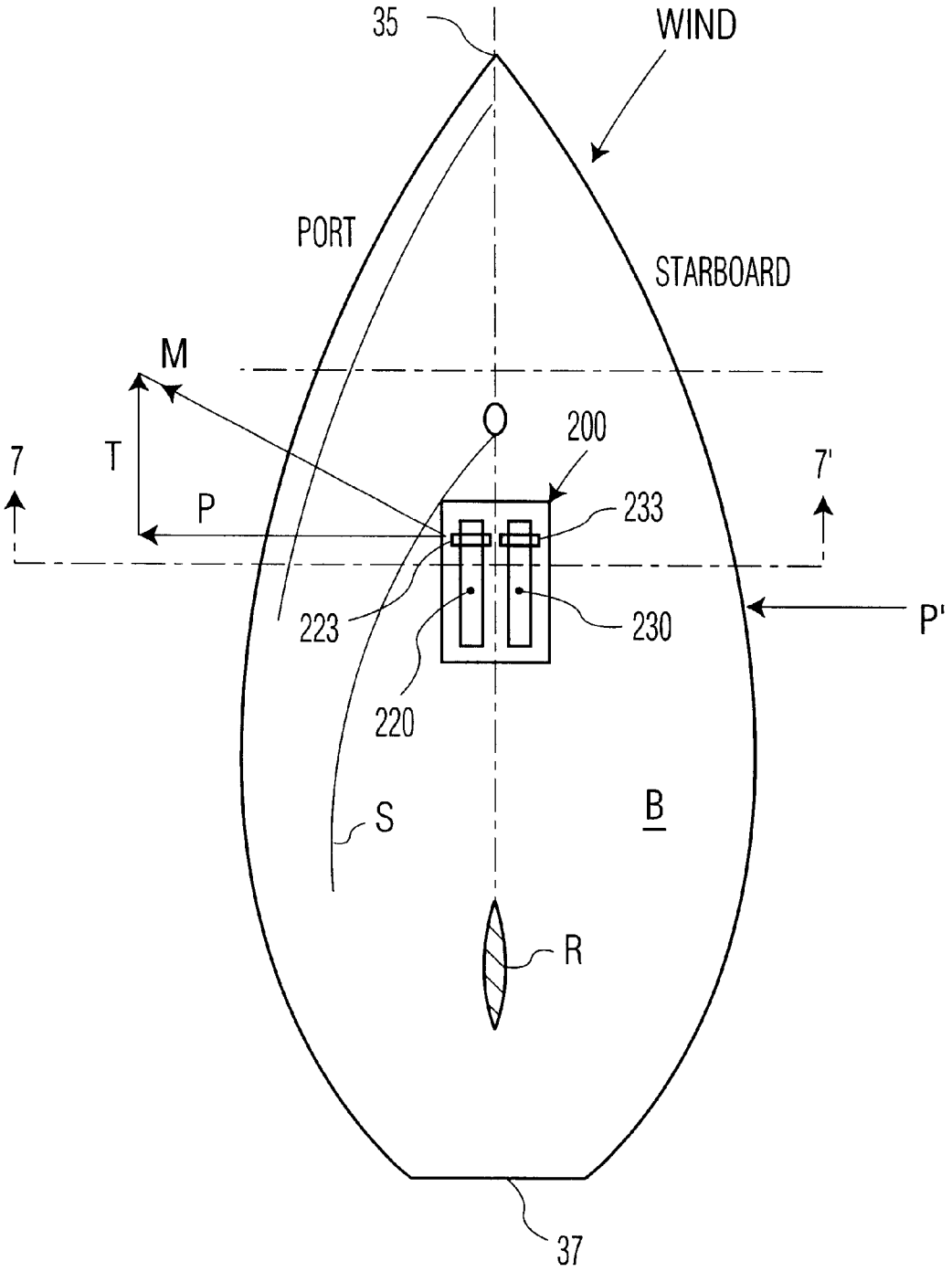
FIG. 6 is a top plan view of another embodiment of a centerboard yacht on starboard tack with a double trunk for two hydrofoil keel wings.
Figure 9:
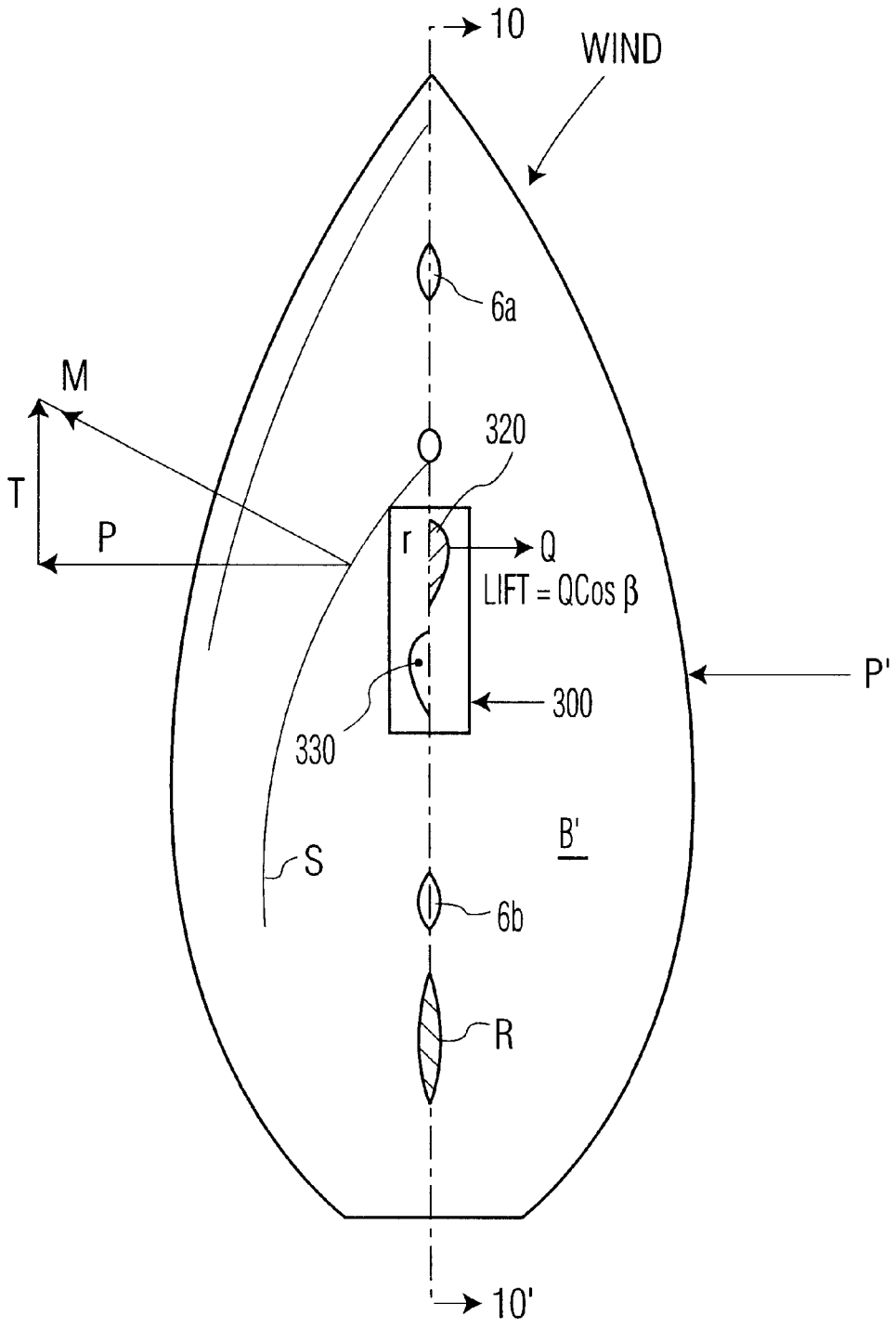
FIG. 9 is a top plan view of another embodiment of an underwater appendage illustrating sliding keels.

Before the insertion of a cambered wing, assume that the leeward drift of the yacht per unit time is Y feet so that the wasted drift energy per unit of time can be represented as (P' x Y), where P' is the leeward water force on the hull, see FIGS. 2 and 3 as produced by the wind component P acting on the sails (also shown in FIGS. 6 and 9). If the insertion of a asymmetric wing reduces the wind leeward drift force vector P' by a factor such as 25%, then the drift distance S is thereby reduced by 25% as caused by the 25% reduction in the leeward drift force vector P'. As a result, the leeward drift energy L (energy=force times distance) is potentially reduced to 56% (75%×75%) of what it was prior to the immersion of the asymmetric wing. However, the added drag "d" by the wing and the increase in the entropy "e" reduces this potential result. But as long as "d"+"e" is less than "g", then "F" mathematically must increase to (F+f) and the yacht's forward speed is increased according to formula (2) hereinabove. Also, the sailing vessel path to a windward destination will be shorter as the consequence of less leeward drift.

Accordingly, for a constant available wind energy, the forward speed of the yacht will be increased and the yacht will appear to point higher by:

(a) Reducing the drift energy, and (b) Employing a submerged asymmetric wing as disclosed in this specification wherein its added drag energy Plus the added entropy loss is less than the larger reduction in the leeward drift energy.

As shown in FIGS. 3*a*, 5, 6 and 9 a sailing vessel, such as a sailboat or sailing yacht on a 20° starboard tack, pointing upwind moves in two directions, namely in the desired forward direction and in the sidewise undesired drift direction. Guided by the jib, the wind W on the main sail generated a force M which has a component T propelling the yacht forwardly and a component P causing leeward drift. The wind drift force P on the sails is transferred by the mast and main sheet to the force P' on the hull to effectuate leeward drift of the yacht.

In the drawings FIGS. 1, 3, 4, 9, 10, 15 and 16, the hulls have a fin keel 6 with ballast 8 in the known manner to provide the necessary righting moment for limiting the hull heel so that the sail will not spill and inordinate amount of useful wing. As is known in the prior art, keel 6 and ballast 8 can be shaped as symmetrical airfoils so that favorable "keel lift" can be generated when the yacht is expertly steered so that the keel 6 has a 3° to 5° leeway angle of attack as shown in FIG. 1*b* on page 51 of the article "KEELS", in the January 1984 issue of the magazine "YACHT RACING and CRUISING".

As shown in FIG. 1, there is provided an underwater appendage 10, depending from the hull 4 and positioned forward of, and in line with, the fin keel 6 having the ballast 8. Appendage 10 can advantageously have symmetrical cambered surfaces. The appendage 10 has an aperture 12 therein to snugly infit a rotatable wing member 10*a* about an axis substantially parallel to the plane of the yacht's circumferential water line 9. A gasket 15 around the periphery of the aperture 12 is used to prevent leakage through the clearance space between the wing 10*a* and appendage 10 when the wing 10a has pressure differences on opposite sides thereof when the wing 10*a* is perpendicular to the yacht's waterline plane 9.

As shown in FIG. 2, one side 16 of wing 10*a* has a cambered hydrofoil shape and its other side 14 is shown as flat. Hereinafter, side 16 will be referred to as the "greater cambered" side and side 14 will be referred to as the "lesser cambered" side of asymmetrical wings. Pairs of cambered surfaces 16 and 14, wing side 14 not necessarily being flat, can be selected from "Theory of Wing Sections" by Abbott & Von Doenhoff which illustrates various wing sections for designing both sides of asymmetrical wings with the important Reynolds numbers, lift and drag coefficients and other engineering data for maximizing the performance of wings. Examples of useful asymmetrical shapes will be disclosed hereinafter.

Figure 3A:
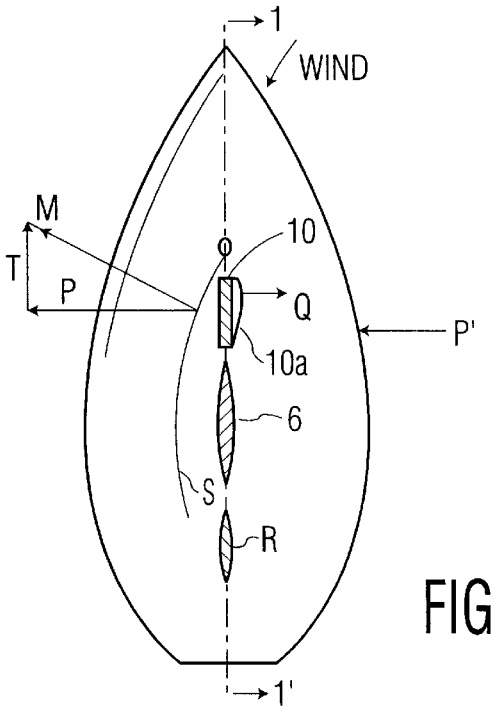
FIG. 3*a* is a schematic diagram of the tacking sailboat of FIG. 1 showing wind and water forces thereon.

Wing member 10*a* resembles an airplane wing with a "chord" perpendicular to the yachts circumferential waterline 9 and a "span" parallel thereto. The leading edge 17 of the wing 10*a* is pointed towards the bow of the hull 13 and a trailing edge 18 is pointed towards the stern of the hull 13. As with airplane wings, side 14 of wing 10*a* need not be flat as explained hereinbefore. In FIG. 3, the wing member 10*a* has a zero angle of attack relative to longitudinal axis of the hull 13 and the yacht is heeled 20°. When the oncoming water impinges upon the leading edge 17 of wing member 10*a*, a lift force Q is generated. In FIG. 3*a*, the wind acting on the sail S generates a force M which has a horizontal component P which is transferred to the hull as force vector P' which causes the leeward drift of the hull.

Rotatable wing member 10a has a shaft 20 attached thereto which is journaled in bearings 20*a* and 20*b* in appendage 10. Shaft 20 is parallel relative to the plane of the yacht's water line 9 and bisects the upstanding leading edge 17 and trailing edge 18 of wing 10*a*.

Figure 4:
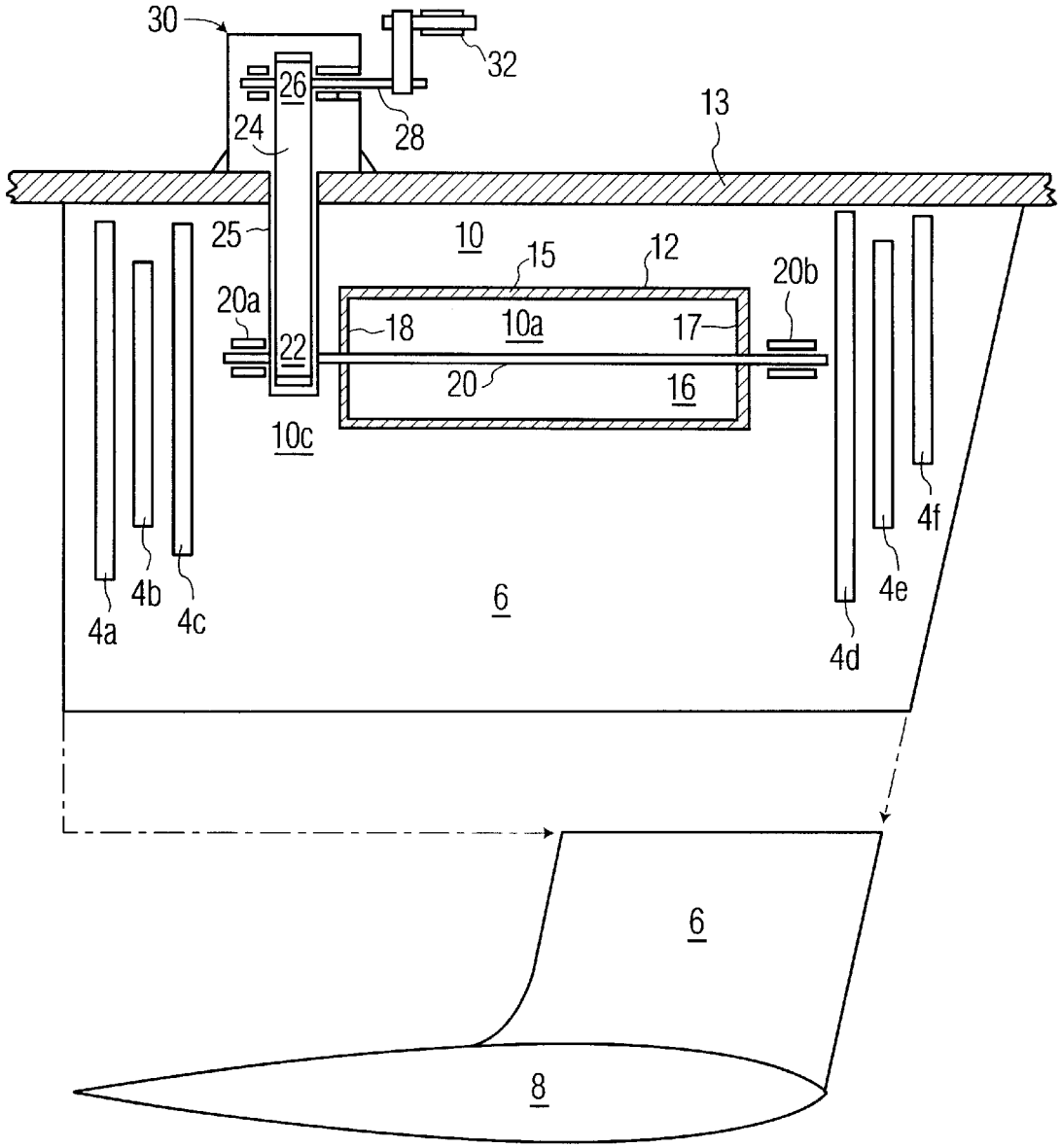
FIG. 4 is a partial schematic crossectional view of another embodiment of an asymmetric underwater appendage.

When the yacht is on starboard tack as shown in FIGS. 1 and 4, the flat side 14 of wing member 10*a* is on the port side of the keel 6 and the cambered hydrofoil side 16 is on the starboard side. When the yacht changes to port tack and while it is "head to the wind", shaft 20 is rotated 180° either clockwise or counter clockwise by a sprocket 22 attached to the shaft 20 to engage a chain 24 which moves through an interior cavity 25 in the appendage 10, through an opening in the hull 13 and into the interior of the yacht. Chain 24 engages a sprocket 26, the axle 28 of which is supported by housing 30. Turning the axle 28 turns shaft 20 to move the cambered surface 16 of the wing 10*a* to either port or starboard. The turning of the axle 28 can be accomplished by a hand crank 32 or by a prior art hydraulic motor system (not shown). Alternatively, the shaft 20 can by turned by a prior art flexible torque transmitting cable (not shown), one end of the flexible torque transmitting wire element being attached to shaft 20 and the other end being located in the cockpit where the wire is turnable by hand or by a hydraulic motor having convenient controls as known in the prior art. The outer casing of the cable is anchored to the appendage 10 in a known manner.

When the boat is heeled on starboard, for example 20° as in FIG. 3, the lift force Q generated by cambered surface 16 is reduced to Q×cosine 20° and is approximately 93% of Q. However, the approximately 7% wasted portion of Q at 20% heel can be potentially reduced by rotating the wing 10*a* for a counter clockwise displacement of 20° so that the leading edge 17 of wing member 10*a* is substantially vertical relative to the water surface Ws.

When the direction of the boat is changed to port tack, shaft 20 is rotated 180°, either clockwise or counter clockwise, by crank 32 so that the cambered surface 16 is rotated to position 16' in FIG. 2 which is on the port side relative to keel 6 and the flat surface 14 is rotated to 14'.

For the tacking yacht in FIGS. 1 and 2 with wing 10*a* perpendicular to the waterline 9 circumference, there is a pressure difference between the port and starboard side thereof. Any leakage through the clearance space between wing 10*a* and appendage 10 is eliminated by gasket 13 in the periphery of the aperture 12.

Figure 10:
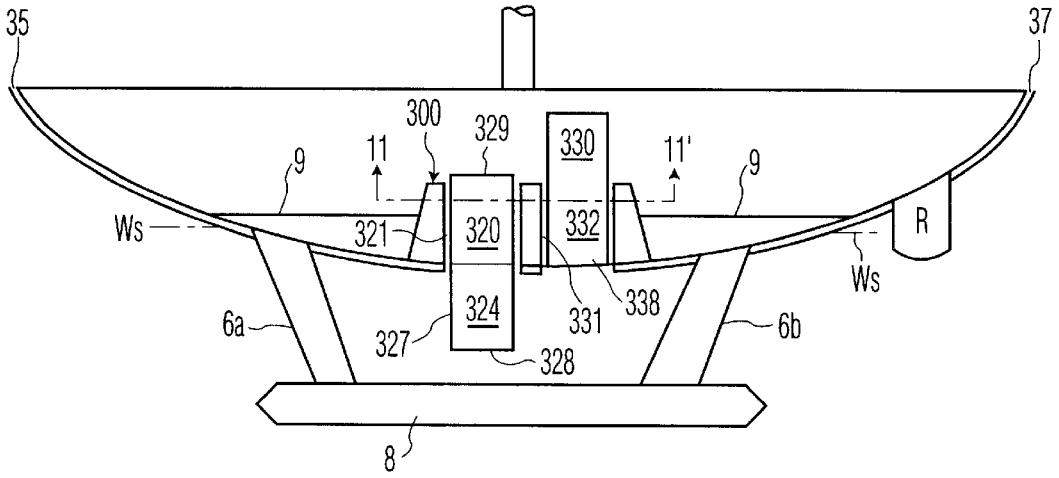
FIG. 10 is a partial crossectional view along line 10–10' of FIG. 9.

Alternatively, the appendage 10 with rotatable wing 10*a* can be installed aft of the yacht keel 6 or between keels 6*a* and 6*b* for tandem keel configurations, see FIGS. 9 and 10.

Figure 5:
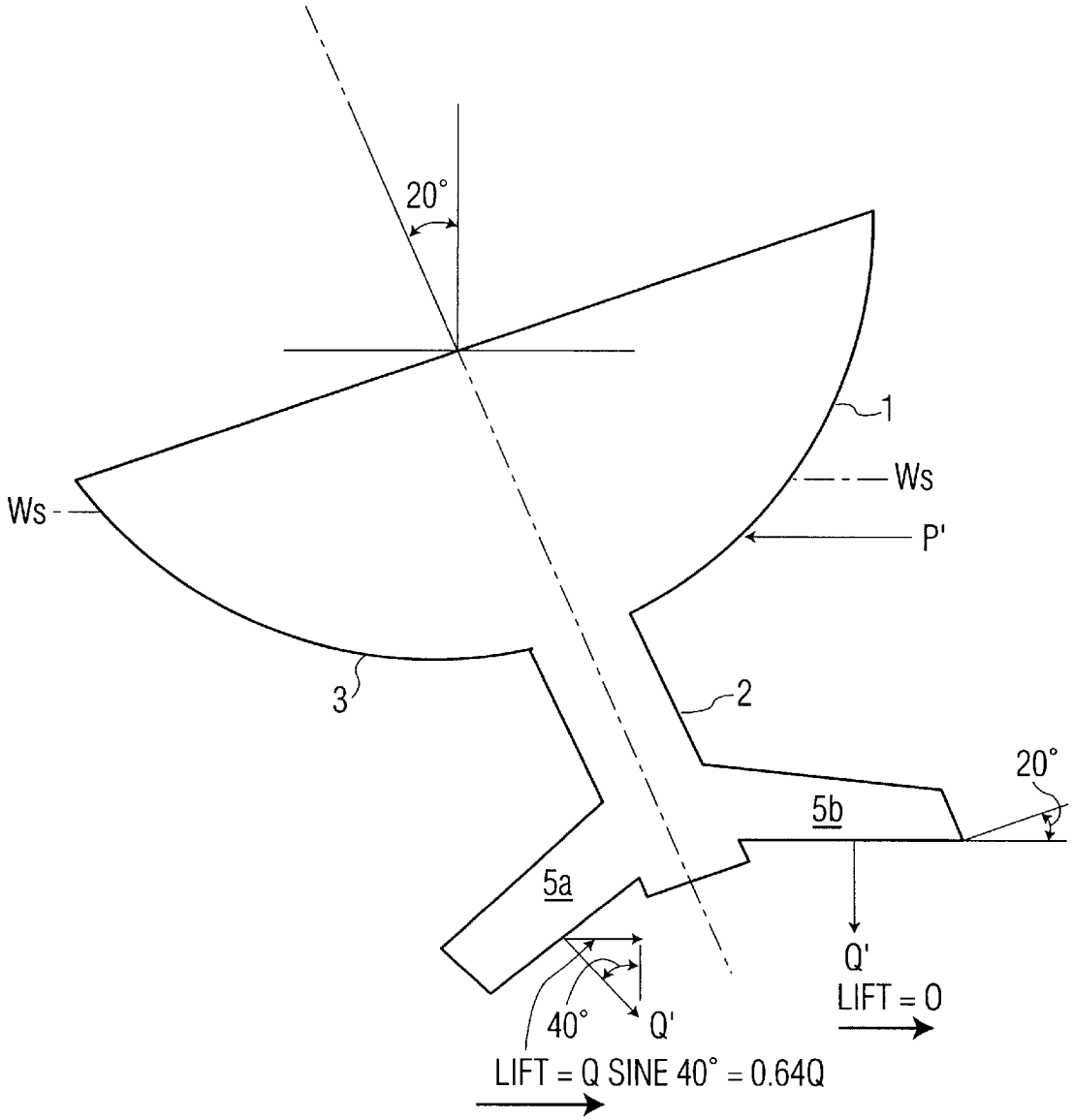
FIG. 5 PRIOR ART
FIG. 5 is a view of a 20° heeled yacht on starboard tack which corresponding to FIG. 3 in Australian Patent Application AU-A-85 668/82.

FIG. 5 of this application corresponds to FIG. 3 of the Australian Patent Application AU-A-85668/82 when the yacht is heeled 20° on starboard tack. In Australian Patent Application AU-A-85668/82, as shown in FIG. 5, fins 5*a* and 5*b* are fixed to keel 2. The cambered underside of port fin 5*a* is slanted counter clockwise 20°. The camber on the underside of 5*b* is clockwise slanted 20°. One undesirable consequence of the fins 5*a* and 5*b*, as shown in FIG. 5, is the potential of damage to the fins when the yacht is accidently grounded. Applicant's embodiments described and claimed in this application do not have such a consequence. When the yacht is on starboard tack and heeled 20°, the hydrofoil underside of fin 5*b* is rotated 20° counterclockwise to a horizontal position and the lift force vector Q' therefrom is downwardly vertical relative to the horizontal water surface Ws. As a result there is no vector force component from the starboard fin 5*b* to counteract the wind drift force vector P' and 100% of its Q' is wasted.

When the yacht in FIG. 5 is on starboard tack and heeled 20°, the hydrofoil surface on the underside of 5*a* is rotated 20° counter clockwise to 20°=20°=40° relative to the water surface Ws. As a result there is a horizontal force equal to Q' sine 40° or 0.64Q' to counteract the wind leeward drift force vector P'. The other 36% of Q' is wasted and not available for lift.

Referring to FIGS. 2 and 3, when a sailboat on starboard tack is heeled 20°, the lift force vector is Q cos 20°, or 0.93Q. A lift comparison with FIG. 5 reveals that if the area and shape of hydrofoil surface 16 of wing 10*a* of the embodiment shown in FIG. 1 is equal to the area and shape of each hydrofoil surface of fin 5*a* in FIG. 5, then Q in FIGS. 2 and 3 equals Q' in fin 5*a* (the Q' of fin 5*b* contributes zero to lift) in FIG. 5. When the yacht is heeled 20°, the advantage in lift for the embodiments as shown in FIGS. 1, 2, 3, 4, 6, 7, 8, 9, 10, 11, 12, 13, 14, 15 and 16 over the prior art of Ben Lexcen's design as shown in FIG. 5 is potentially an improvement in lift of 0.64 (in FIG. 5) to lift of 0.93 (in all the embodiments) for a lift improvement of 0.93/0.64, or 1.45. Additionally, if the area of surface 16 in FIG. 1 is equal to the area of 5*a* plus 5*b*, then Q equals 2 Q', and the improvement of the embodiments of the applicant in lift is doubled to 1.86/0.64, for an improvement factor of 2.90, when the yacht is heeled 20% either starboard or port.

As to the important aspect of drag, if the area of each of the two fins 5*a* and 5*b* of FIG. 5 is equal to the area of the single wing member 10*a* of FIG. 1, the underwater drag of the two fins 5*a* and 5*b* in FIG. 5 is twice the drag of the single hydrofoil appendages of FIGS. 1, 2, 3, 4, 6, 7, 8, 9, 10, 11, 12, 13, 14, 15 and 16.

Accordingly, the teaching in this application greatly improves the Lift/Drag Ratio as is needed for successful wing appendages and which, in the prior art winged keels, was too low. This could explain why the store bought "put-on" winged keels manufactured since 1982 that attempted to use Ben Lexcen's winged keel design have not been successful and prompted many winged keel purchasers to remove them. Adverse comments of the many renowned naval architects on the subject of Ben Lexcen's design appear on page 54 of the article "KEELS", in the January 1984 issue of the magazine "YACHT RACING and CRUISING".

When the heel of the vessel in FIGS. 1, 4, 6, 7, 8, 9, 10, 11, 12, 13, 14, 15 and 16 is changed from 20° to 10°, the useful lift force of Q is increased from Q cos 20° (0.93Q) to Q cos 10° (0.98Q) for an improvement of 5.4%.

When the heel of Ben Lexcen's design in FIG. 5 is changed from 20° to 10°, the fin 5*a* has a positive lift of Q'sin 30°, or +0.50Q', but the fin 5*b* has a negative lift of Q'sin 10°, or −0.174Q', for a net lift of +0.326. Accordingly, when the heel of the yacht in applicant's embodiments is changed from 20° to 10°, the lift increases from 0.93 to 0.98 for an improvement in the lift of 5.4% as compared to the lift in FIG. 5 being reduced from 0.64 to 0.326, a reduction of 49%.

When the yacht is on a 20° heeled starboard tack, an added advantage of the embodiments in FIGS. 1 and 4 is that the useful lift force Q can potentially be increased to 1.0Q by rotating wing 10*a* an angular displacement of 20° clockwise and on port tack by rotating wing 10*a* an angular displacement of 20° counter clockwise.

In FIGS. 1, 2, 3 and 4, when the boat is sailing with the wind, the vessel with its sails can be strategically jibed while wing 10a is rotated 180° to selectively expose the cambered shape 16 to either port or starboard for providing useful lift for each jibe. Very importantly, the Ben Lexcen's winged keel of FIG. 3 in his Australian Patent (FIG. 5 in this specification) cannot increase hull forward velocity when sailing with the wind and both his fins 5*a* and 5*b* offer no lift but only very substantial drag. As navigation requires, the rotatable wing member 10*a* can be rotated to a horizontal position so that the generated force of its cambered surface 16 is upward or downward to produce no port or starboard lift.

As another embodiment, the aperture 12 could be cut out of an upper section of keel 6, as shown in FIG. 4 to accommodate the rotatable wing member 10*a* with gasket 15. This embodiment eliminates the appendage member 10 in FIG. 1 for supporting wing 10*a*. FIG. 2 is applicable to FIG. 4 as it is to FIG. 1. The keel 6 in FIG. 4 should be designed so that it is not structurally weakened by the aperture 12. The keel in FIG. 4 is stressed by not only the normal keel stresses of sea and waves but further by the hydrofoil force generated by the wing 10*a* which is transmitted to the keel 6 by shaft 20 acting on bearings 20*a* and 20*b*. For structural strength, the embodiment in FIG. 4 shows imbedded vertical longitudinal steel rods 4, 4*a*, 4*b* . . . 4*n* in keel 6 fore and aft of the wing member 10*a* which are the weakened portions of keel 6 caused by aperture 12. Another embodiment (not shown) can have a fore and aft widening in the shape of keel 6 adjacent to wing 10*a* to provide necessary strength to the keel portion which is weakened by the aperture 12. If desired, wing member 10*a* can be located on the keel 6 further down from the yacht's hull 4.

In FIGS. 1, 2 and 4, the aft sections 10*c* and 10*d* of appendage 10 can act as an "end plate" and advantageously reduce the induced drag of wing member 10*a*.

Figure 7:
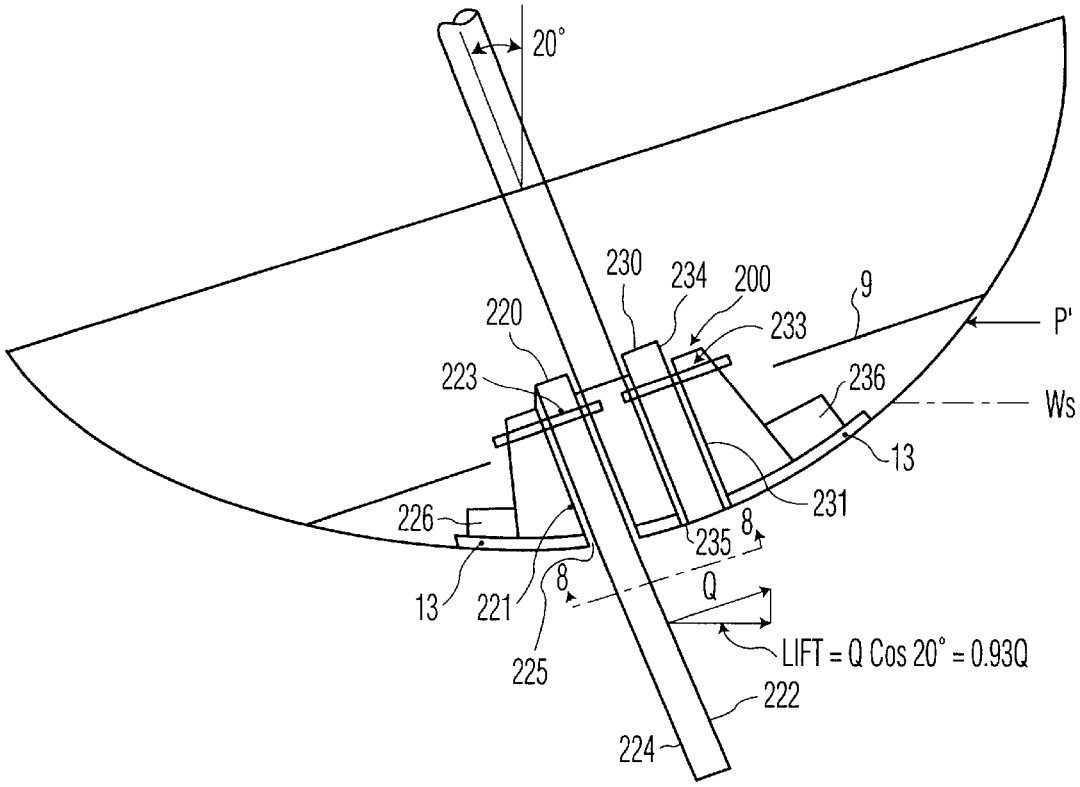
FIG. 7 is a partial schematic crossectional view along line 7–7' of FIG. 6.
Figure 8:
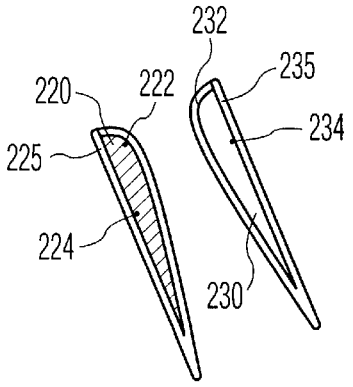
FIG. 8 is a crossectional view along line 8–8' of FIG. 7.

Another embodiment as shown in FIGS. 6, 7 and 8 is applicable to centerboard vessels having a boxlike trunk through which an appendage such as a pivoted heavy keel with asymmetric cambered surfaces is swingable. The heavy swinging keel provides the necessary righting moments for the vessel. There generally is no need in centerboard boats for a fin keel 6 and ballast 8.

In FIGS. 6, 7 and 8, there is illustrated a centerboard vessel having a bow 35 and a stern 37 with a double trunk 200 through which two rotatable asymmetric wings 220 and 230 can be separately and selectively swung into and out of the water on their axles 223 and 233, such axles being substantially parallel to the plane of the yacht's waterline 9 of the vessel. While FIGS. 6, 7 and 8 show wings 220 and 230 in spaced parallel relationship to the longitudinal centerline of the yacht, it is to be understood that each of the two wings 220 and 230, with their respective trunks, can be separately located directly on the vessel centerline as required by some racing rule classes and as shown in the embodiment FIGS. 9, 10 and 11 (which are there shown for sliding wing members).

The vessel in FIGS. 7 and 8 is shown as heeled 20° on starboard tack. In this embodiment, the heavy keel wing 220 and 230 are rotatable in their separate cavities 221, 231 of the double trunk 200 by a known mechanism (not shown).

In FIGS. 7 and 8, rotatable asymmetric wing 220 is positioned in the cavity of 221 of the double trunk 200 on the port side of the longitudinal centerline of the vessel and rotatable hydrofoil wing 230 is positioned in the cavity 231 on the starboard side of longitudinal centerline of the vessel. Keel wing member 220 has a cambered surface 222 on its starboard side and a lesser cambered surface 224 (shown as flat) on its port side. Keel wing member 230 has cambered surface 232 on its port side and less cambered surface 234 on its starboard side.

Figure 12:
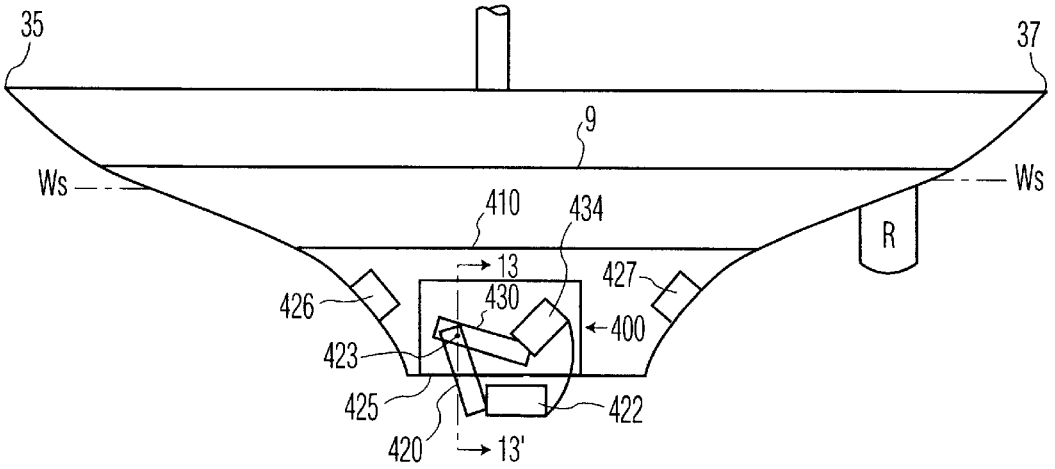
FIG. 12 is a partial schematic view of another embodiment illustrating a centerboard trunk below the waterline.

Cambered surfaces 222, 232 and flat surfaces 224, 234 on wings 220 and 230 should be rectangular in outer circumference as are cambered surfaces 422 and 432 in FIG. 12. Cambered surfaces 222 and 232 of wing members 220 and 230 should rest in their lowest positions with their span parallel to the plane of the waterline 9 and their chords perpendicular to the plane of the waterline 9.

In FIGS. 6 and 7, the vessel is close hauled on starboard tack with a heel angle of 20°, the keel wing 220 has been lowered into the water to its final position with the span of hydrofoil surface 222 parallel to the longitudinal hull centerline and hydrofoil keel wing 230 has been lifted completely out of the water. In FIG. 7, wing 220 generates a lift force Q with a component Q cos 20° or 0.93Q in opposition to the drift force P' generated by the wind acting on sail S. The wasted drift force is only 0.07 of Q.

When the boat changes to port tack and preferably at the instant when the boat is "head to wind", hydrofoil keel wing member 230 is lowered into the water to its proper rest position as disclosed above while hydrofoil wing member 220 is lifted completely out of the water. Any prior art mechanism (not shown) can be employed for moving wing members 220 and 230.

Since internal ballast can be advantageously used in some centerboard vessels, internal ballast is shown as 226, 236 in FIG. 7.

While the vessel in FIGS. 6, 7 and 8 show the rotatable keel wing 220 and its cavity on the port side and rotatable keel wing 230 and its cavity on the starboard side thereof, their positions could be advantageously interchanged in view of the different vortex shedding, boundary layer separation and keel downwash on the port and starboard sides of the heeled hull. When either wing member 220 or 230 is lowered into the water, its cambered surface 222 or 232 should face windwardly.

The counter drift force Fcd can be either its maximum when the centerboard is completely lowered or zero when it is completely lifted. When the boat is sailing with the wind, asymmetric keel wing members 220 and 230 can both be rotated completely out of the water.

Figure 15:
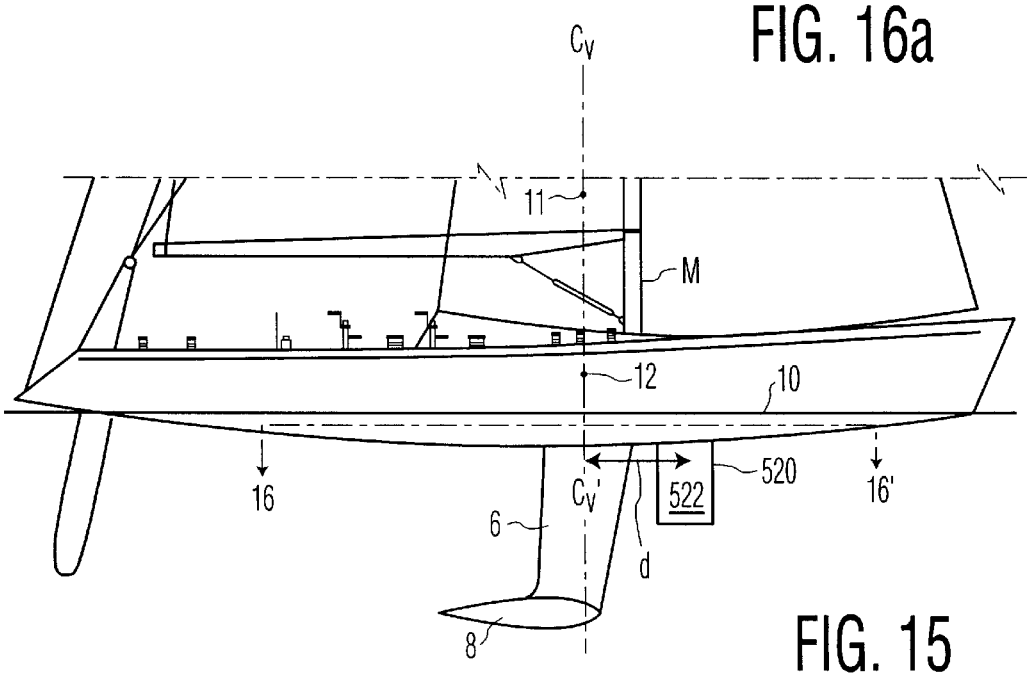
FIG. 15 is an elevation view of another embodiment of the invention.

It is to be understood that the hull in FIGS. 6, 7 and 8 can have a fin keel and ballast (for instance, as shown in FIG. 15) so that wings 220,230 in FIGS. 6, 7 and 8 can be light weight asymmetric appendages which are swingable in their trunk cavities 221,231.

Figure 11:
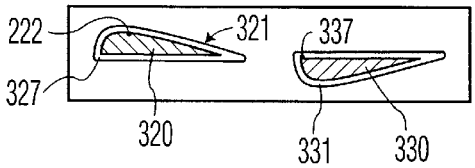
FIG. 11 is a partial crossectional view along line 11–11' of FIG. 10.

In another embodiment, as illustrated in FIGS. 9, 10 and 11, the asymmetric wings 320 and 330 are slidably moved up and down into and out of the water in their individual cavities 321 and 331 which can be located on the longitudinal centerline of the vessel. The tandem keel members 6*a* and 6*b* straddle the wings 320 and 330 and support ballast 8.

The asymmetric 320 and 330 in FIGS. 9 and 10 can be fabricated of metal or structural plastic, preferably with hollow interiors, so that they will be light in weight for easy vertical up and down movements. Necessary righting moments for the embodiment are provided by ballast 8 in FIG. 10 as supported by the tandem keels 6*a* and 6*b*.

The prior art has equipment which can be used to accomplish the lifting and lowering of the hydrofoil members 320 and 330 in FIGS. 9 and 10 and for that reason lifting mechanisms are not illustrated in the drawings. When 320 and 330 are light in weight, they may even be moved by hand power as desired in small sailboats. All sliding surfaces can be grease lubricated for easy movement of 320 and 330.

Figure 16:
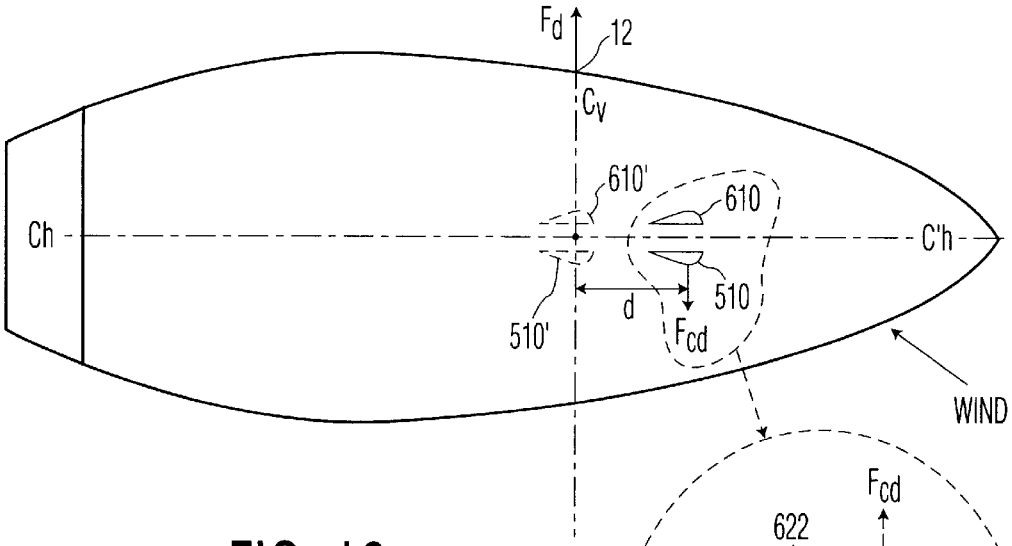
FIG. 16 is a crossectional view along lines 16–16' of FIG. 15.
Figure 16A:
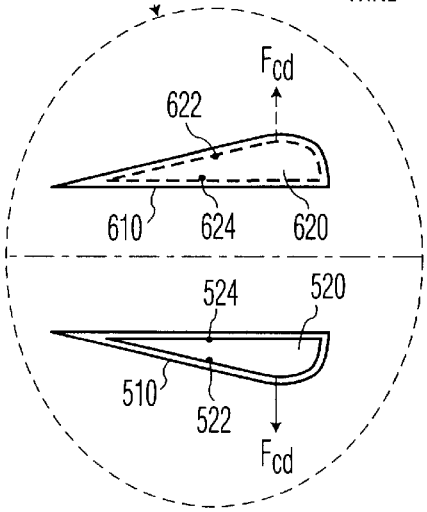
FIG. 16*a* is an exploded view showing the trunks and sliding appendages illustrated in a portion of FIG. 16.

While FIGS. 9, 10 and 11 illustrate the two sliding wings 320 and 330 in cavities 321 and 331 of trunk 300 which are positioned in spaced relationship on the longitudinal centerline of the boat, it is understood that cavities 321 and 331 together with their wings 320,230 in FIGS. 9, 10 and 11 can be selectively located in side by side relationship straddling the hull longitudinal centerline as shown in FIGS. 16 and 16*a* for cavities 510 and 610 and their sliding wings 520 and 620. Using the teachings and disclosures in FIGS. 16, 17 and 18 the trunk 300 for wings 320,330 can be selectively and variably located in a selective location relative to the resultant of the center of wind pressure on the sail and center of water pressure on the hull for providing selective weather helm.

In reference to FIGS. 9 and 10, only one slidable wing 320 is necessary with cambered surfaces 324 and 322 as is shown for wing 320. The trunk 300 remains with cavities 321,331 either on the longitudinal centerline of the hull or positioned side by side and straddling the hulls longitudinal center line (as for instance shown in FIG. 6). On starboard tack, the single asymmetric wing 320 is lowered with its end surface 328 in a downward position, with its cambered surface 322 facing starboard and with its leading edge 327 pointing toward the bow 35. When changing to the port tack, the wing 320 is lifted out of the cavity 321 of trunk 300, turned upside down by 180° and lowered with its 329 end surface in a downward position in the other cavity 331 of trunk 300 with the cambered surface 322 facing port and with its leading edge 327 pointing towards the bow 35.

Since there are tremendous bending and shearing stresses upon all hydrofoil wing members and upon all their trunks, such members have to be strongly designed to avoid failure in severe winds and large waves.

When the yacht is hauled out of the water and keel design secrecy is desired, the asymmetric wings 320 and 330 in FIGS. 9 and 10 can both be lifted into the locked private interior of the yacht in a manner so that their undersides 328 and 338 are flushed with the outside of the hull. If necessary, the exposed small gaps between the wings and the side walls of the cavities in the trunk can be sealed or glassed over and made invisible in a known manner. The same teaching applies to the embodiments shown in FIGS. 15, 16, 17 and 18 to establish secrecy of the keel design when the yacht is hauled out of the water.

Figure 13:
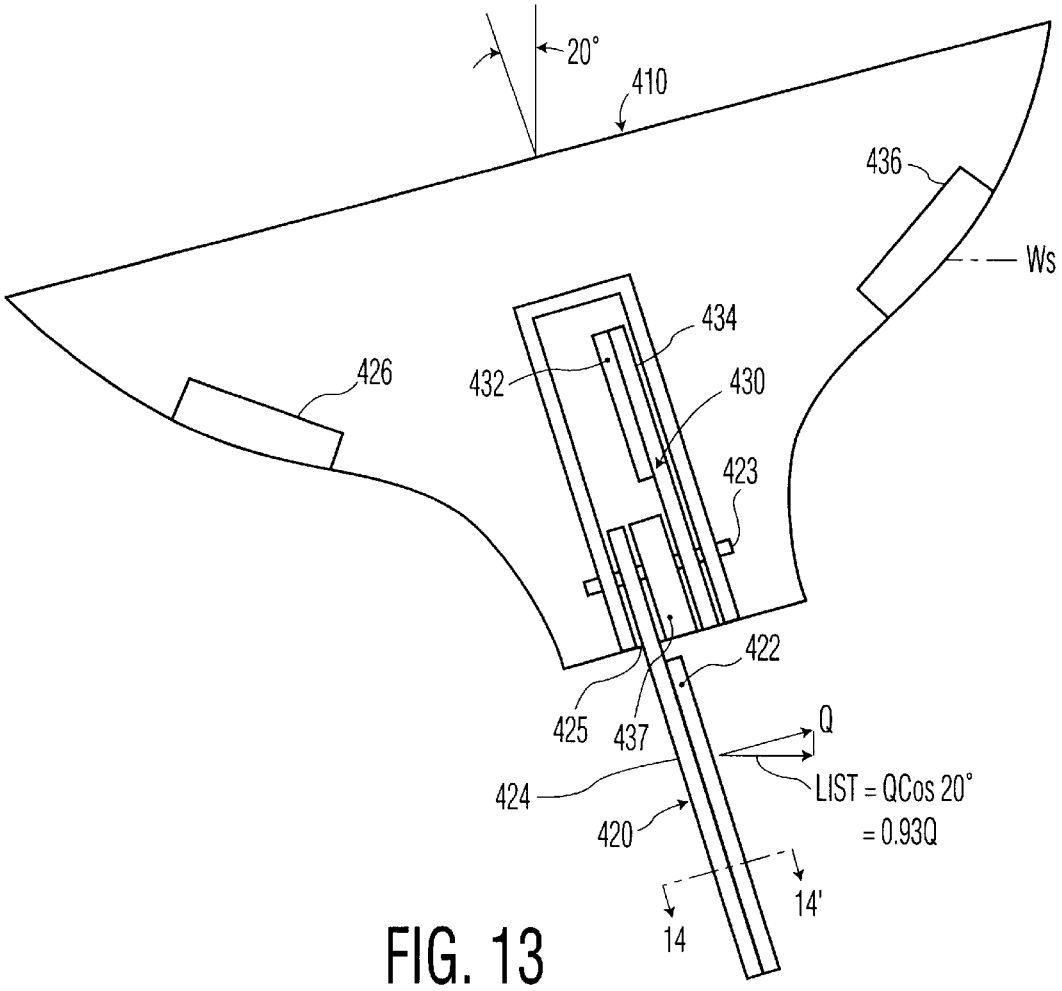
FIG. 13 is a partial schematic crossectional view along line 13–13' of FIG. 12.
Figure 14:
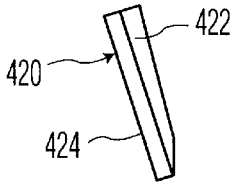
FIG. 14 is a crossectional view along lines 14–14' of FIG. 13.

Another embodiment is illustrated in FIGS. 12, 13 and 14. In FIG. 12, the centerboard trunk 400 is located below the interior of the vessel and below its cabin sole 410 to provide more living space in the interior of the vessel for its occupants.

In FIGS. 12, 13 and 14, the yacht is sailing with a heel of 20° on starboard tack and the single centerboard in a submerged trunk is replaced by two hydrofoil wing members 420 and 430, each of which is separately and selectively rotated out of the trunk 400 and into the water through the opening 425 in the bottom of the trunk 400. When the yacht is sailing on starboard tack as shown in FIG. 13, port wing member 420 is lowered to its proper rest position as disclosed in the next paragraph and starboard wing 430 is positioned completely within trunk 400.

When either cambered surfaces 422 or 432 is in its lowest rest position, its span should be parallel to the plane of the yacht waterline 9 and its chord perpendicular to the plane of the waterline 9.

Yachts with submerged trunks since about 1980 have prior art mechanism to rotate its one centerboard into and out of its submerged trunk 400. The two asymmetric wing members 420 and 430 of this embodiment can be separately rotated by using such prior art lifting mechanisms (not shown), one for wing member 420 and one for wing member 430. As shown in FIG. 13, wing member 420 has a cambered surface 422 on its starboard side and a flat surface 424 on its port side. Wing member 430 has a cambered surface 432 on its port side and a flat surface 434 on its starboard side. An axle 423 with its axis parallel to the plane of the yacht's waterline 9 rotatably supports both wing members 420 and 430. When the moving water passes over the cambered surface 422, a force Q is generated which has a lift of Q cos 20°, or 0.93Q to counter the undesirable leeward drift force P' as generated by the wind acting on the sails.

When the yacht is sailing on port tack, asymmetric wing 420 is raised completely into the trunk 400 and wing member 430 is rotated out of the trunk to a rest position so that the span dimension of its hydrofoil surface 422 is parallel to the plane of the circumferential waterline 9. Asymmetric wing members 420 and 430 are separated by a spacer 437 on axle 423 so that each wing can rotate without rubbing against the other wing.

For providing the required righting moment against the action of the wind on the sails, internal ballast 426, 436 is often attached to the hull in convenient places below the yacht's interior livingspace which is above the sole 430.

Figure 17:
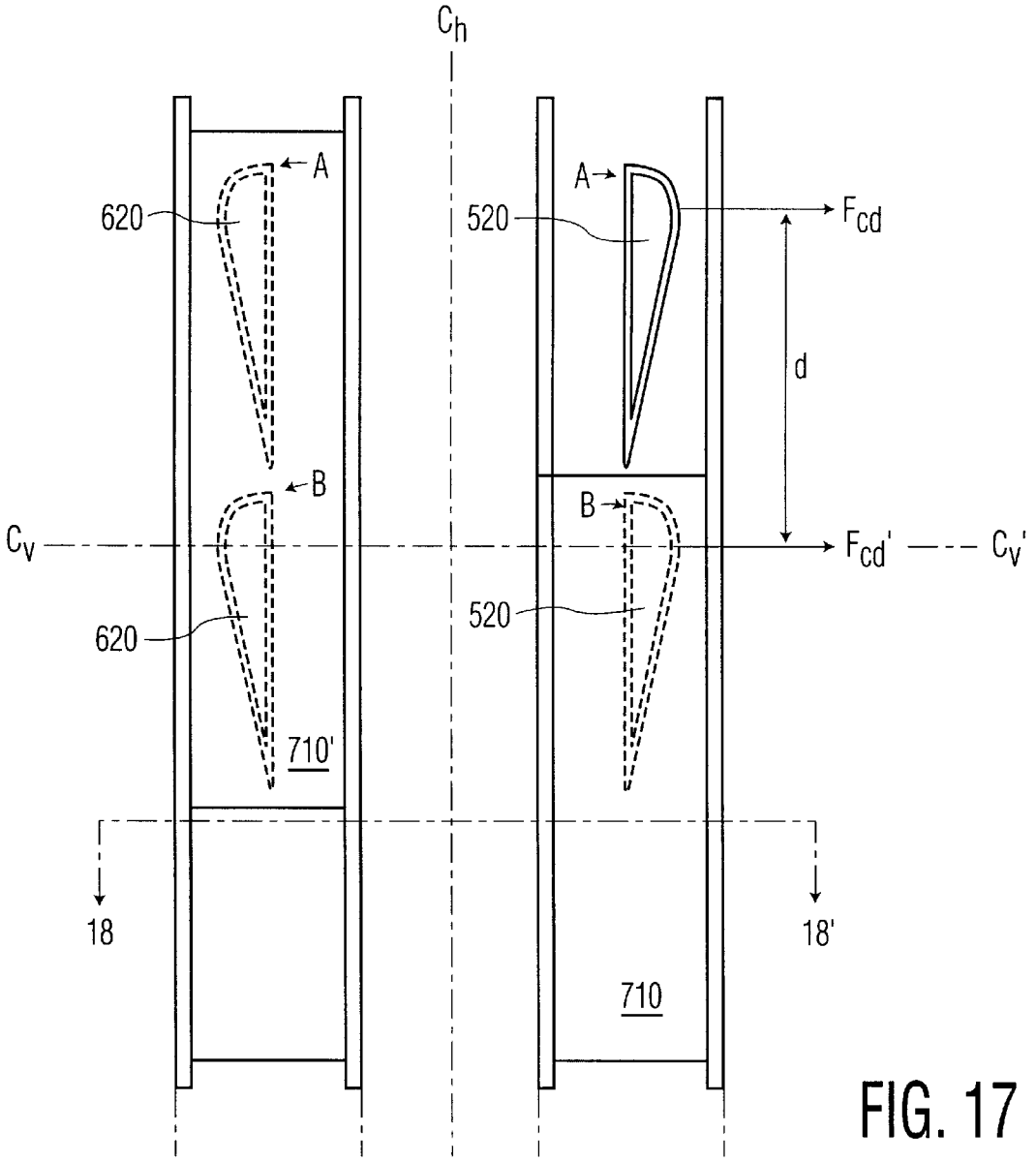
FIG. 17 is a vertical crossectional view along lines 17–17' of FIG. 15 which illustrates an improvement of the embodiment of FIG. 15; and, FIG. 18 is a cross-section view along line 18–18' on FIG. 17.
Figure 18:
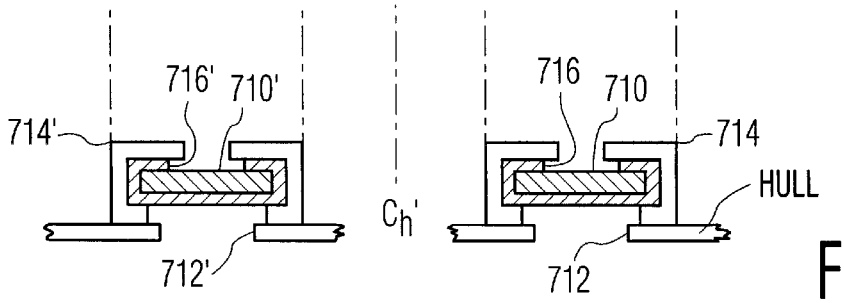

Another embodiment is illustrated in FIGS. 15, 16 and 16*a* wherein the yacht on a starboard tack has a prior art fin keel 6 with ballast 8. For illustrative purposes, the center of wind pressure 11 upon the sails (shown as having a Genoa Jib and a Main Sail) and the center of water pressure 12 upon the hull when it is moved leewardly by the wind are generally in or near a plane Cv,Cv' which is perpendicular to the plane of the yacht's water line 10. At a selected distance forward of Cv,Cv' are two trunks (not shown) with cavities 510,610 straddling the fore/aft centerline Ch,Ch' of the hull, trunk cavity 510 accommodates a slidable asymmetric starboard wing 520 and trunk cavity 610 accommodates a port asymmetric wing 620, each wing being movable into and out of the water. FIG. 16*a* is an exploded view of a portion of FIG. 16 to show details of the trunk cavities 510,610 and the slidable wings 520,620 therein. In FIGS. 16*a*, 17 and 18, wings 520,620 are shown in full lines when they are down into the water and in dotted lines when up and out of the water. Wing 520 has a selected cambered surface 522 on its starboard side and a selected less cambered surface 524 on its port side, surface 524 being shown as flat in FIGS. 16 and 16*a*. Wing 620 has a selected cambered surface 622 on its port side and a selected less cambered surface 624 on its starboard side, surface 624 being shown as flat in FIGS. 16 and 16*a*.

When the yacht is on starboard tack (or starboard reach), wing 520 is moved downwardly into the water and wing 620 is lifted out of the water. The effective exposed areas of surfaces 522,524 to the water are controlled by the selective downward displacement of wings 520,620 so that the magnitude of the generated counter-drift force Fcd is varied for changing conditions of the sea and the wind. For instance, when the yacht is sailing with the wind, both wings 520,620 are lifted out of the water to desirably reduce the drag of the wings 520,620 to zero and to desirably reduce the counter-drift forces Fcd of 520,620 to zero.

When the yacht is on port tack (or port reach), wing 620 is lowered a selective distance into the water to similarly control the generated counter drift force Fcd as desired for changing conditions of sea and wind and wing 520 is lifted out of the water.

In addition to the generation of the counterdrift force Fcd from the surface 522 of wing 510 in FIGS. 16 and 16*a*, when the yacht is on starboard tack, another important feature of this embodiment is the generation of a clockwise turning moment Fcd×d upon the hull, d being the distance between Fcd and the vertical plane Cv,Cv'. Accordingly, the yacht very desirably will point higher into the wind. For the same reasons, the yacht on port tack will point higher into the wind when wing 520 is raised out of the water and wing 620 is lowered into the water.

The improvement in pointing and yacht speed can be maximized by proper selection of the shape of the two cambered surfaces, the amount that the wing is trust into the water and the distance d between the plane CvCv' and the generated counter drift force Fcd. The amount of weather helm changes as distance d is changed. To reduce the weather helm, the location of wing cavities 510,610 can be selectively moved sternwardly so that the distance d is shortened and the turning moment into the wind is reduced to Fcd×a shortened distance d.

The weather helm can be fine tuned by installing a sternwardly series of starboard and port wing cavities 510, 510', 510" . . . and 610, 610', 610" . . . (not shown) at selective distances from Cv,Cv'. Optionally, a single starboard wing 520 and a single port wing 620 can be selectively moved between the desired the maximum and minimum distances of d as shown on FIGS. 15, 16, 17 and 18.

As illustrated in FIGS. 15, 16, 16*a* and explained herein above, the magnitude of the counter drift force Fcd generated by the water passing over the cambered surface 524,624 is selectively controlled by the selective exposure of the wings 520,620 below the hull of the yacht and into the water. When the counter drift force Fcd is generated, it also determines the magnitude of the clockwise angular displacement, or twist, into the wind. Therefore, the desired magnitude of Fcd for the desired counter drift force could result in undesired excessive weather helm when distance d unduely increases the torque arm. The undesired weather helm can be corrected by reducing the distance between the wings 520,620 and Cv,Cv' so as to shorten the torque arm d.

As shown in FIG. 17, when the yacht is on a starboard tack, the starboard wing 520 is variably movable from a selective position A to another selective position B so that the torque arm "d" as shown in FIGS. 15 and 16, is changed to another selected dimension. Accordingly, the torque arm of Fcd can be selectively changed to make the yacht point higher into the wind for a desired magnitude of Fcd without causing undesirable weather helm or undesirable lee helm. For a desired weather helm and maximizing the Velocity Made Good (VMG), the helmsman being the man skilled in the art and in control of the yacht selects the distance d and the amount of exposure of the wing into the water for the maximum performance of the yacht.

FIGS. 17 and 18 illustrate an embodiment whereby the distance d in FIG. 15 is able to be instantly variable between selective maximum and minimum distances.

In FIG. 17, the starboard trunk and cavity 510 and wing 520 therein are mounted on a slidable member 710 which can be moved along a longitudinal aperture 712 in the yacht's hull between the position A when undesirable weather helm appears and a position B when the torque arm d is reduced to zero. Member 710 slides in a "C" shaped support 714 fixed to the yacht hull which covers the hull aperture 712 while slidable member 710 and trunk 520 are moved between positions A and B. Packing 716 between slide 710 and the "C" shaped member 714 prevents sea water from entering the interior of the hull through the aperture 712. The top of trunk for wing 520 is mechanically supported by rollers and rods (not shown) in a prior art manner to provide mechanical strength to the trunk supporting wing 520 while permitting movements of the trunk in fore and aft directions within the limits of positions A and B.

The embodiment in FIGS. 17 and 18 requires structure for also variably moving the port wing 620 between positions A and B, such port structure requiring a sliding member 710', an aperture in the hull 712', a C member 714' and packing 716' between the sliding member 710 and the C member 714'.

In FIGS. 16, 16*a* and 17, the slidable wings 520,620 should be light in weight for easy movement since their weight is not needed for providing needed righting moments during tacking yacht windwardly maneuvers.

When the yacht is heeled 20°, this embodiment has the same potential improvement over the winged keel shown in FIG. 5 as that set forth hereinabove for FIG. 1, namely a factor of 1.45, when the area of each surface 222, 232, is equal to area of the hydrofoil surface of fin 5*a*. However, if the areas of each hydrofoil surface 222, 232, is equal to the areas of fins 5*a* plus 5*b*, then the improvement compared to Ben Lexcen's FIG. 5 can potentially be 2.90.

Asymmetrical Wing Shapes

Useful shapes of wing sections have been developed and coded by NASA and published in "Theory of Wing Sections" by Abbott and Von Doenhoff, Dover Publications. While NASA has developed shapes for very high speed air craft, some NASA shapes are useful for applicant's appendages operating in water (which is incompressible) because at very high wing speeds in air, the air medium approaches incompressibility.

A few published useful NASA wing shapes for applicant's upper and lower asymmetrical appendage shapes are:

1. Upper Surface: NACA 63, A12 Lower Surface: NACA 63-006
2. Upper Surface: NACA 63, A015 Lower Surface: NACA 63-006
3. Upper Surface: NACA 64 Lower Surface: NACA 250
4. Upper Surface: NACA 66 Lower Surface: NACA 240
5. Upper Surface: NACA 63, A12Lower Surface: FLAT
6. Upper Surface: NACA 63, A015 Lower Surface: FLAT
7. Upper Surface: NACA 64 Lower Surface: FLAT
8. Upper Surface: NACA 66 Lower Surface: FLAT By naval architectural calculations, tank testing and sea trials, improvements bought about by the embodiments can be determined for maximum performance of the sailing vessel. Also to determined is the best location for the center of wind pressure, center of water pressure, center of buoyancy, the yacht's masts, keel, the ballast (with or without prior art winglets) and the best location for the wings and their trunks. Furthermore, experimentation is needed for the best shape and contour of the asymmetrical wings to maximize the yacht performance.

While there has been described and pointed out the fundamental novel features of the present invention as applied to preferred embodiments, it will be understood that various omissions and substitutions and changes in the form and details of the Underwater Hydrofoil Wing (or Appendage) for a Sailing Vessel illustrated and it's construction may be made using equivalents by those skilled in the art, without departing from the spirit of the invention.

What is claimed is:

1. Method for increasing the forward movement of a tacking sailing vessel which is driven by a wind force vector in a favorable forward direction and in an unfavorable leeward drift direction and having at least one submergible appendage with a cambered surface and a less cambered surface so that said appendage generates a lift force vector when water passes thereover including the steps of selectively shaping said cambered surface on said appendage to provide a high lift/drag ratio for said appendage so that the amount of wasted energy being saved is substantial when the sailing vessel drifts leewardly is equal to the difference between the wind force vector in said leeward drift direction and the lift force vector times the reduced leeward drift distance in a given period of time resulting from the reduced wind force vector in said leeward drift direction by said lift force vector, such multiplication product being greater than the amount of the incremental increase in the wasted drag energy by water passing over said appendage plus the lost entropy energy associated with the energy transfer, said saved energy increasing the forward speed of the sailing yacht because energy cannot be destroyed, and selectively adjusting the position of said appendage longitudinally on the hull relative to a center of the wind pressure upon the sails of said sailing vessel to controllably move a center of water pressure upon the appendage for producing a selected amount of weather helm for offsetting the undesirable lee helm upon the sailing vessel produced by said lift force vector acting upon the appendage.

2. Method according to claim 1 including the step of selectively shaping said cambered surface as shown in NACA 63,A012; NACA 63-006; NACA 63-008; NACA 63,A015; NACA 63; NACA 64 and NACA 66.

3. Method according to claim 2 including the step of moving said appendage along the hull centerline of said sailing vessel for providing a selective torque upon the vessel into the wind for reducing the lee helm produced by the appendage which is in the water.

4. Method according to claim 2 including the steps of providing another appendage having a cambered surface and a less cambered surface, the sailing vessel having a hull circumferential waterline and a longitudinal hull centerline plane from the bow to the stern of the hull, straddling said appendage and said another appendage on said longitudinal hull centerline plane, pointing the leading edges of said appendage and said another appendage towards the bow of the hull, pointing the trailing edges of the two appendages towards the stern of the hull, positioning said appendage and said other appendage so that the generated lift vectors of their cambered surfaces point in opposite directions in perpendicular aspect to said longitudinal hull centerline plane, selectively moving one of the appendages a selected distance into the water so as to control the magnitude of the generated lift force vectors and selectively avoiding the occurrence of both appendages being in the water at the same time.

5. Method according to claim 4 including the steps of providing a centerboard trunk and pivoting said appendage and said another appendage to said trunk as centerboards.

6. Method according to claim 4 including the steps of providing a sliding keel trunk and laterally sliding said appendage and said another appendage into and out of said sliding keel trunk for a selective distance into and out of the water so as to vary the magnitude of said keel lift force.

7. Method according to claim 2 including the steps of providing a waterline on the hull, said at least one appendage being a single appendage juxtapositioned to the bottom of the hull in perpendicular aspect to said waterline plane, providing a cavity in said appendage, providing a wing to fit into said cavity in said appendage, said cambered surface being selectively shaped on said wing with its chord in parallel relationship to the plane of said waterline, attaching a shaft to said wing, journalling said shaft in said cavity with its axis in parallel relationship to said waterline plane and selectively rotating said shaft for providing port and starboard lift force vectors.

8. Method according to claim 7 including the step of providing a gasket in the space between said cavity and said appendage to prevent water from passing between said wing and said appendage.

9. Method according to claim 2 wherein the sailing vessel has a fin keel with a ballast attached to the end thereof juxtapositioned to the bottom of the hull in perpendicular aspect to said waterline and said appendage is a single wing including the steps of providing a cavity in said fin keel, attaching a shaft to said wing in parallel relationship to the chord of said fin keel, journalling said shaft in said cavity with its axis in parallel relationship to said waterline plane and selectively rotating said shaft for providing port and starboard lift force vectors.

10. Method according to claim 9 including the step of providing a gasket in the space between said cavity and said fin keel to prevent water from passing between said wing and said fin keel.

11. A method of increasing the velocity of a sailing vessel moving in a body of water and decreasing its leeward drift, said sailing being in a state of equilibrium in accordance with the energy balance:

$$W=F+L+D+E,$$

where

W=Energy of the wind

F=Energy of the wind which forwardly propels the sailing vessel

L=Energy wasted by the sailing vessel drifting leewardly by the wind

D=Energy wasted by drag of the hull

E=Entropy lost energy said method comprising the steps of selectively exposing an appendage having a cambered surface and a less cambered surface, in the water, generating a lift force vector by the water passing over the cambered surface on said appendage, directing said lift force vector counter to the direction of drift of the sailing vessel by the wind, more greatly reducing the waisted drift energy then the additional drag energy of said appendage in the moving water plus the energy increase in entropy so as to change the balance of energy to:

$$W=(F+f)+(L-g)+(D+d)+(E+e),$$

where

W=Energy of the wind

F=Energy of the wind which forwardly propels the sailing vessel before the exposure of the cambered surface of the wing to the water f=The increase in energy for increasing the vessel forward velocity when the asymmetric wing is exposed to the water L=Energy wasted by the sailboat drifting leewardly by the wind g=Leeward Drift Energy saved when asymmetric wing is exposed to the water D=Drag Energy wasted by water passing over the submerged portion of the sailing vessel before exposing the asymmetric wing to the water d=The increase in drag energy wasted by water passing over the asymmetric wing E=Entropy wasted energy before exposing asymmetric wing to the water, and e=The increase in entropy energy wasted when the asymmetric wing is exposed to the water whereby so that the forward velocity of the sailing vessel is increased provided "g" is greater than "d"+"e" and adjusting said appendage longitudinally position relative to a center of the wind pressure upon the sails of said sailing vessel to controlably move a center of water pressure upon the appendage to produce a selected amount of weather helm for offsetting the undesirable lee helm upon the sailing vessel produced by said lift force vector acting upon the appendage.

12. Method according to claim 11 including the step of selectively shaping said cambered surface as shown in NACA 63,A012; NACA 63-006; NACA 63-008; NACA 63,A015; NACA 63; NACA 64 and NACA 66.

13. An appendage adapted to be exposed in a stream of water under a tacking sailing vessel being driven by a wind force vector upon its sails which drives said tacking sailing vessel in a desired forward direction and in an undesired leeward drift direction, which comprises at least one appendage having a cambered surface and a less cambered surface, means moveably securing said appendage to the hull of the sailing vessel, said cambered surface on said appendage being selectively shaped to have a high lift/drag ratio so that the amount of wasted energy saved when the sailing vessel drifts leewardly is equal to the difference between the wind force vector in said leeward drift direction and the lift force vector times the reduced leeward drift distance in a given period of time resulting from the reduced wind force vector in said leeward drift direction, such multiplication product being greater than the amount of the incremental increase in the wasted drag energy by water passing over said appendage plus the lost entropy energy associated with the energy transfer, said saved energy increasing the forward speed of the sailing yacht because energy cannot be destroyed, and adjusting said appendage longitudinally position relative to a center of the wind pressure upon the sails of said sailing vessel to controlably move a center of water pressure upon the appendage to produce a selected amount of weather helm for offsetting the undesirable lee helm upon the sailing vessel produced by said lift force vector acting upon the appendage and means to move the center of water pressure upon said appendage to produce weather helm for offsetting the undesirable lee helm upon a sailing vessel produced by said lift force vector on said appendage.

14. An appendage according to claim 13 wherein said cambered surface is selectively shaped as shown in NACA 63,A012; NACA 63-006; NACA 63-008; NACA 63,A015; NACA 63; NACA 64 and NACA 66.

15. An appendage according to claim 14 including means to moveably move said appendage along the hull centerline of said sailing vessel for providing a selective torque upon the vessel into the wind for reducing the lee helm produced by the appendage which is in the water.

16. An appendage according to claim 14, said appendage having another less cambered surface and including another appendage having a cambered surface and a less cambered surface, a hull circumferential waterline, a longitudinal hull centerline plane from the bow to the stern of the hull, means straddling said appendage and said another appendage on said longitudinal hull centerline plane, the leading edges of said appendage and said another appendage being pointed towards the bow of the hull and the trailing edges of the two appendages being pointed towards the stern of the hull, said appendage and said other appendage the generating lift vectors on their cambered surfaces pointing in opposite directions in perpendicular aspect to said longitudinal hull centerline plane, means selectively moving one of the appendages a selected distance into the water to vary the magnitude of the keel lift force and selectively avoiding the occurrence of both appendages being in the water at the same time.

17. A sailing vessel having two appendages according to claim 16 and including a sliding keel trunk and means laterally moving said appendage and said another appendage in said trunk so as to vary said lift force vectors, said two appendages acting as sliding keels.

18. a sailing vessel having two appendages according to claim 16 and including a centerboard trunk and means pivoting said appendage and said another appendage to said trunk, said two appendages acting as centerboards.

19. An appendage according to claim 14 wherein said sailing vessel has a hull waterline, said at least one appendage being a single appendage juxtapositioned to the bottom of the hull and in perpendicular aspect to said waterline, and including a cavity in said appendage, a wing adapted to be inserted in said cavity in said appendage, said cambered surface being selectively shaped on said wing with its chord in parallel relationship to the chord of said fin keel, means attaching a shaft to said wing, means journalling said shaft in said cavity with its axis in parallel relationship to said waterline and means selectively rotating said shaft for providing port and starboard lift force vectors.

20. An appendage according to claim 19 including a gasket in the space between said cavity and said wing to prevent water from passing therethrough.

21. An appendage according to claim 14 wherein said sailing vessel has a fin keel and a hull waterline, said at least one appendage being a single wing, including a cavity in said fin keel, said wing being adapted to be inserted in said cavity in said fin keel, a cambered surface being selectively shaped on said wing with its chord in parallel relationship to the chord of said fin keel, means attaching a shaft to said wing, means journalling said shaft in said cavity with its axis in parallel relationship to said waterline and means selectively rotating said shaft for providing port and starboard lift force vectors.

22. An appendage according to claim 21 including a gasket in the space between said cavity and said fin keel to prevent water from passing between said wing and said fin keel.

23. The sailing vessel moving in a body of water in the state of equilibrium in accordance with the energy balance:

$$W=F+L+D+E,$$

where

W=Energy of the wind

F=Energy of the wind which forwardly propels the sailing vessel

L=Energy wasted by the sailing vessel drifting leewardly by the wind

D=Energy wasted by drag of the hull

E=Entropy lost energy said sailing vessel comprising at least one submergible appendage having a cambered surface and a less cambered surface for increasing the sailboat's forward speed and decreasing its windward drift, means for selectively exposing said submergible appendage for reducing the wasted leeward drift energy of the sailing vessel and for selectively positioning its cambered surfaces so that a force generated by the water passing over said cambered surfaces has a component to counter the sailboat's windward drift for changing the energy balance to:

$$W=(F+f)+(L-g)+(D+d)+(E+e),$$

where

W=Energy of the wind

F=Energy of the wind which forwardly propels the sailing vessel before the exposure of the cambered surface of the wing to the water f=The increase in energy for increasing the vessel forward velocity when the asymmetric wing is exposed to the water L=Energy wasted by the sailboat drifting leewardly by the wind g=Leeward Drift Energy saved when asymmetric wing is exposed to the water D=Draft Energy wasted by water passing over the submerged portion of the sailing vessel before exposing the asymmetric wing to the water d=The increase in drag energy wasted by water passing over the asymmetric wing E=Entropy wasted energy before exposing asymmetric wing to the water, and e=The increase in entropy energy wasted when the asymmetric wing is exposed to the water whereby, the forward velocity of the sailing vessel is increased provided "g" is greater than "d"+"e" and means adjusting said appendage longitudinally position relative to a center of the wind pressure upon the sails of said sailing vessel to controlably move a center of water pressure upon the appendage to produce a selected amount of weather helm for offsetting the undesirable lee helm upon the sailing vessel produced by said lift force vector acting upon the appendage.

24. An appendage according to claim 23 wherein said cambered surface is selectively shaped as shown in NACA 63,A012; NACA 63-006; NACA 63-008; NACA 63,A015; NACA 63; NACA 64 and NACA 66.

* * * * *